US009726176B2

(12) United States Patent
Graham

(10) Patent No.: US 9,726,176 B2
(45) Date of Patent: Aug. 8, 2017

(54) VACUUM PUMPING

(71) Applicant: EDWARDS LIMITED, Crawley, West Sussex (GB)

(72) Inventor: Ingo Stephen Graham, Hove (GB)

(73) Assignee: Edwards Limited, Crawley (GB)

( * ) Notice: Subject to any disclaimer, the term of this patent is extended or adjusted under 35 U.S.C. 154(b) by 340 days.

(21) Appl. No.: 13/716,957

(22) Filed: Dec. 17, 2012

(65) Prior Publication Data

US 2013/0164147 A1 Jun. 27, 2013

(30) Foreign Application Priority Data

Dec. 23, 2011 (GB) ..... 1122226.2

(51) Int. Cl.

| | |
|---|---|
| ***F04C 28/00*** | (2006.01) |
| ***F04C 23/00*** | (2006.01) |
| ***F04C 25/02*** | (2006.01) |
| ***F04C 28/02*** | (2006.01) |
| ***F04C 29/00*** | (2006.01) |

(52) U.S. Cl.

CPC ..... *F04C 28/00* (2013.01); *F04C 23/001* (2013.01); *F04C 25/02* (2013.01); *F04C 28/02* (2013.01); *F04C 29/0092* (2013.01); *F04C 2270/56* (2013.01); *F04C 2280/02* (2013.01)

(58) Field of Classification Search

CPC .. F04C 23/001; F04C 23/008; F04C 2220/10; F04C 2220/30; F04C 25/02

USPC ..... 417/244, 248, 251; 137/565.23

See application file for complete search history.

(56) References Cited

U.S. PATENT DOCUMENTS

| | | | | |
|---|---|---|---|---|
| 4,850,806 | A * | 7/1989 | Morgan | F04B 37/14 417/205 |
| 6,177,129 | B1 * | 1/2001 | Wagner et al. | 427/8 |
| 2004/0126495 | A1 * | 7/2004 | Hartig et al. | 427/294 |
| 2005/0217993 | A1 * | 10/2005 | Gebele et al. | 204/298.25 |
| 2012/0024394 | A1 | 2/2012 | Bounouar et al. | |

FOREIGN PATENT DOCUMENTS

| | | | |
|---|---|---|---|
| WO | 2006097679 | A1 | 9/2006 |
| WO | 2010070240 | A1 | 6/2010 |

* cited by examiner

*Primary Examiner* — Charles Freay
*Assistant Examiner* — Kenneth J Hansen
(74) *Attorney, Agent, or Firm* — Shumaker & Sieffert, P.A.

(57) ABSTRACT

In order to prevent excessive motor loading or system overheating due to the accumulation of particulate or dust, from SACVD type CVD processes, in the running clearances of the vacuum pump a vacuum pumping arrangement is provided having a plurality of vacuum pumping stages and comprising a first pump inlet through which process fluid from the vacuum chamber can enter the pump and pass through each of the pumping sections towards a pump outlet, and a second pump inlet through which process fluid can enter the pump and pass through only one or more pumping stages downstream of the most upstream pumping stage, wherein the apparatus configured to conveying process fluid from the vacuum chamber to the first pump inlet for pumping during the second processing step and conveying process fluid from the vacuum chamber to the second pump inlet for pumping during the first processing step.

9 Claims, 3 Drawing Sheets

VACUUM PUMPING

The present invention relates to a method of evacuating a vacuum chamber and to a vacuum pumping arrangement for evacuating a vacuum chamber.

In, for example, chemical vapour deposition processes (such as SACVD) particles are generated as a by-product. These particles are pumped through a vacuum pump during evacuation of the vacuum processing chamber in which the process is operated. The particles, or dust, accumulate in running clearances of the vacuum pump, dead volumes (e.g. rotor balance holes/sumps) and build up on surfaces, resulting in frictional loads. The increased loading may be overcome temporarily, but ultimately leads to excessive motor loading or system overheating.

The present invention aims to mitigate the problems associated with particle generation.

The present invention provides a method of evacuating a vacuum process chamber with a vacuum pumping arrangement, wherein in the vacuum chamber a first processing step is performed at a relatively low vacuum and which generates a relatively large amount of particles and a second processing step is performed at a relatively high vacuum (low pressure) and which generates a relatively small amount of particles, the vacuum pump arrangement having a plurality of vacuum pumping stages and comprising a first pump inlet through which process fluid from the vacuum chamber can enter the pump and pass through each of the pumping sections towards a pump outlet, and a second pump inlet through which process fluid from the vacuum chamber can enter the pump and pass through only one or more pumping stages downstream of the most upstream pumping stage, wherein the method comprises conveying process fluid from the vacuum chamber to the first pump inlet for pumping during the second processing step and conveying process fluid from the vacuum chamber to the second pump inlet for pumping during the first processing step.

The present invention also provides a vacuum pumping arrangement comprising a vacuum pump having a plurality of vacuum pumping stages, a first pump inlet through which process fluid from the vacuum chamber can enter the pump and pass through each of the pumping sections towards a pump outlet, a second pump inlet through which process fluid from the vacuum chamber can enter the pump and pass through only one or more pumping stages downstream of the most upstream pumping stage, a fore-line assembly having a first duct for conveying process fluid from a vacuum chamber to the first pump inlet, a second duct for conveying process fluid from the vacuum chamber to the second pump inlet and a valve operable for selectively directing fluid along the first duct or the second duct, and a control configured to convey process fluid from the vacuum chamber to the second pump inlet during a first processing step performed in the vacuum chamber at a relatively low vacuum and which generates a relatively large amount of particles and to convey process fluid from the vacuum chamber to the first pump inlet during a second processing step performed in the vacuum chamber at a relatively high vacuum and which generates a relatively small amount of particles.

Other preferred and/or optional features of the invention are specified in the accompanying claims.

In order that the present invention may be well understood, an embodiment thereof, which is given by way of example only, will now be described with reference to the accompanying drawings, in which.

In a known chemical vapour deposition process, such as SACVD, a chemical vapour deposition step is performed in a vacuum chamber at a relatively low vacuum (e.g. 800 mbar). The deposition step generates a relatively large amount of particles. A cleaning step or other processes, such as etching or conditioning, are performed at a relatively high vacuum (e.g. 1 to 20 mbar). These other processing steps generate relative few particles in comparison to the deposition process step. Typically, when the other processes such as chamber cleaning are completed, a valve, positioned downstream of a vacuum chamber, is operated to throttle the flow of fluid and raise the vacuum chamber pressure from a relatively higher vacuum to a relatively lower vacuum. Therefore, the vacuum pump is configured to be able to evacuate the vacuum chamber to a relatively higher vacuum even though such a higher vacuum is not required for the deposition stage. The recognition that the capacity of the vacuum pump is not fully used throughout processing steps allows implementation of the embodiment of the present invention described with reference to the drawings.

Figure 1:
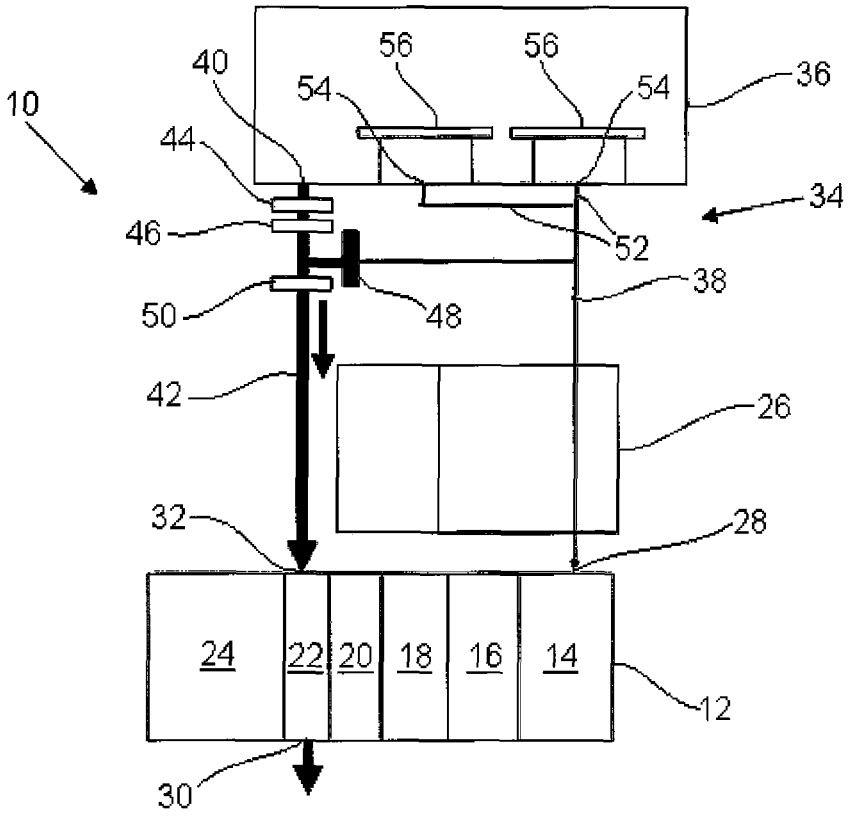
FIG. 1 is a schematic representation of a vacuum pumping arrangement and vacuum chamber in a first condition.
Figure 2:
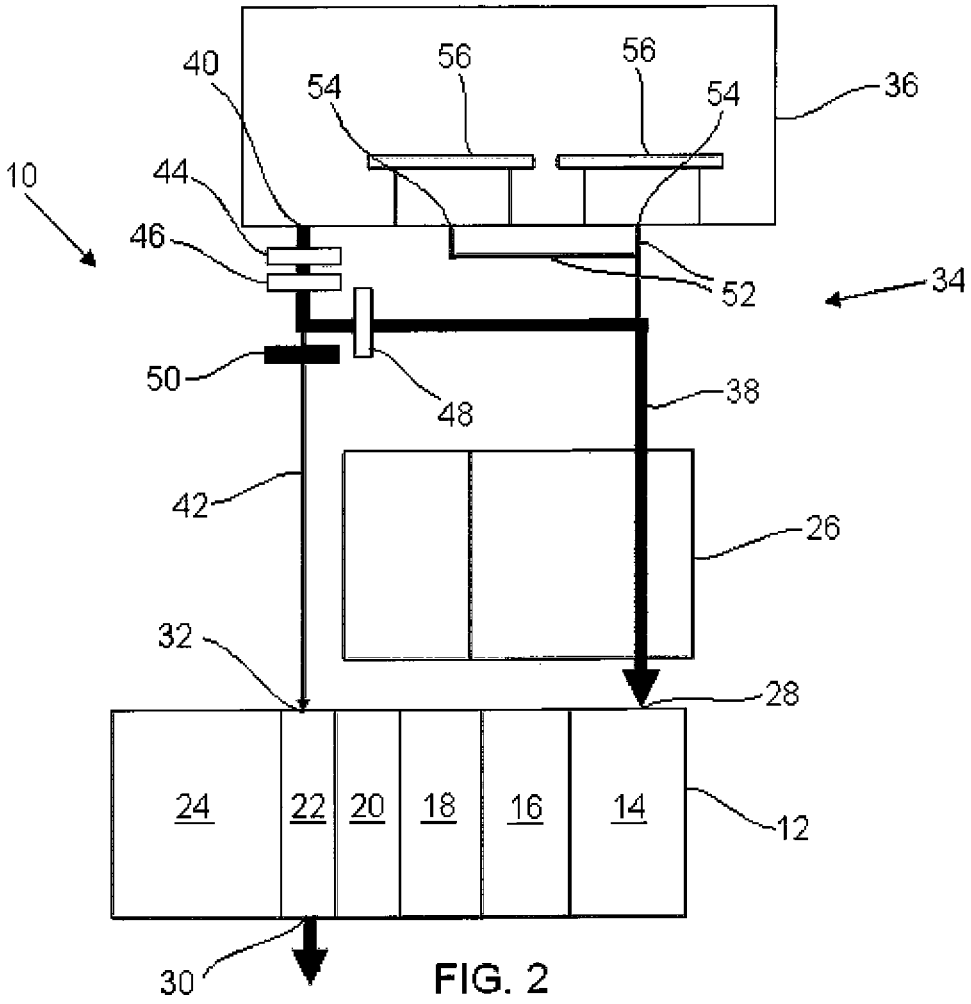
FIG. 2 is a schematic representation of a vacuum pumping arrangement and vacuum chamber in a second condition.

Referring to FIGS. 1 and 2, a vacuum pumping arrangement 10 is shown which comprises a vacuum pump 12 having a plurality of vacuum pumping stages 14, 16, 18, 20, 22. The vacuum pumping stages are driven by a motor 24. In the arrangement shown, vacuum pump 12 can be considered a backing pump for backing a booster pump 26. A first pump inlet 28 is provided through which fluid can enter the pump 12 and pass through each of the pumping sections 14, 16, 18, 20, 22 towards a pump outlet 30. Fluid entering through pump inlet 28 passes first through the booster pump 26. A second pump inlet 32 is provided through which fluid can enter the pump and pass through only one or more of the pumping stages 16, 18, 20, 22 downstream of the most upstream pumping stage 14. In the arrangement shown fluid entering through pump inlet 32 passes through only the downstream pumping stage 22.

A fore-line assembly 34 conveys fluid from a vacuum chamber 36 to the pumps 12 and 26. The assembly has a first duct 38 for conveying fluid from a vacuum chamber to the first pump inlet 28. As shown the duct 38 extends from an outlet 40 of the vacuum chamber to the inlet of the booster pump 26 and from the outlet of the booster pump to the first inlet 28 of the backing pump 12. A second duct 42 conveys fluid from the outlet 40 of the vacuum chamber to the second pump inlet 32.

There are four valves 44, 46, 48, 50 for controlling the flow of process fluid (i.e. process precursors and their reaction by-products) from the chamber outlet 40 to the vacuum pumps 12, 26. Valves 44, 46 are known from the prior art. Valve 44 is an isolation valve for isolating the vacuum chamber from the rest of the fore-line assembly and the pumps. Valve 46 is a throttle valve operable for increasing the pressure in the vacuum chamber from one pressure to a relatively higher pressure for example when a cleaning step has been completed and a deposition step is to be performed.

Valves 48, 50 are isolation valves. Valve 48 has a first condition for allowing the flow of fluid from the vacuum chamber along duct 38 and a second condition for isolating the booster pump and the first pump inlet 28 from the outlet 40 of the vacuum chamber. Valve 50 has a first condition for allowing the flow of fluid along duct 42 and a second condition for isolating the second pump inlet 32 from the outlet 40 of the vacuum chamber.

As shown in FIG. 1 during a relatively low vacuum process, the throttle valve 46 is operated to raise chamber pressure. Valve 48 is in the second condition (indicated in the figure by it being blacked out) and valve 50 is in the first condition so that fluid flows along duct 42 from the chamber outlet 40 to the second pump inlet 32 (as indicated by the bold line) and the booster pump and first pump inlet 28 are isolated from the chamber outlet. In this deposition step, a relatively large amount of the dust or particulates are generated. However, the fluid comprising the entrained particulates and/or dust is conveyed through only one pumping stage 22 of the vacuum pump 12.

As shown in FIG. 2, during a relatively high vacuum process, the throttle valve 46 is operated to provide substantially no resistance to flow such that the vacuum chamber is at a low pressure. Valve 48 is in the first condition and valve 50 is in the second condition (indicated in the figure by it being blacked out) so that fluid from the vacuum chamber flows along duct 38 from the chamber outlet 40 to the booster pump and first pump inlet 28 (as indicated by the bold line) and the second pump inlet 32 is isolated from the chamber outlet. In this process step, a relatively small amount of dust or particulates are generated and therefore the fluid can be pumped by all the vacuum stages of the vacuum pump without significant detriment.

Accordingly, the valve arrangement comprising valves 48, 50 is operable for selectively directing fluid along the first duct 38 or the second duct 42. Alternatively valve arrangements will be apparent to those skilled in the art and may be provided for directing the fluid as required. The valve arrangement may be operated manually dependent on the processing step to be performed. Preferably though a control is configured to convey fluid from the vacuum chamber to the second pump inlet during a first processing step performed in the vacuum chamber at a relatively low vacuum and which generates a relatively large amount of particles and to convey fluid from the vacuum chamber to the first pump inlet during a second processing step performed in the vacuum chamber at a relatively high vacuum and which generates a relatively small amount of particles. The control may receive a signal from a vacuum chamber control unit indicating the process step to be performed, and the control controls the valve arrangement in response to the signal.

The fore-line assembly 34 additionally comprises ducts 52 which convey fluid from chamber outlets 54 to the booster pump and the first pump inlet 28. The ducts 54 are in the example shown partially co-extensive with the duct 38. The vacuum chamber contains vacuum chucks 56 having platforms for receiving wafers or other objects to be processed and the vacuum generated in the chucks maintains the objects (such as silicon wafers) in position on the platforms during processing. Fluid is conveyed from the chamber outlets 54 to the booster pump and the first pump inlet during the first processing step whilst at the same time fluid is evacuated through the chamber outlet 40 to the second pump inlet 32. That is, operation of the valve arrangement does not affect fluid flow from outlets 54 which is generally continuous regardless of the process step. The vacuum chucks need not be operable when objects are not within the vacuum chamber for example during a chamber cleaning step.

Figure 3:
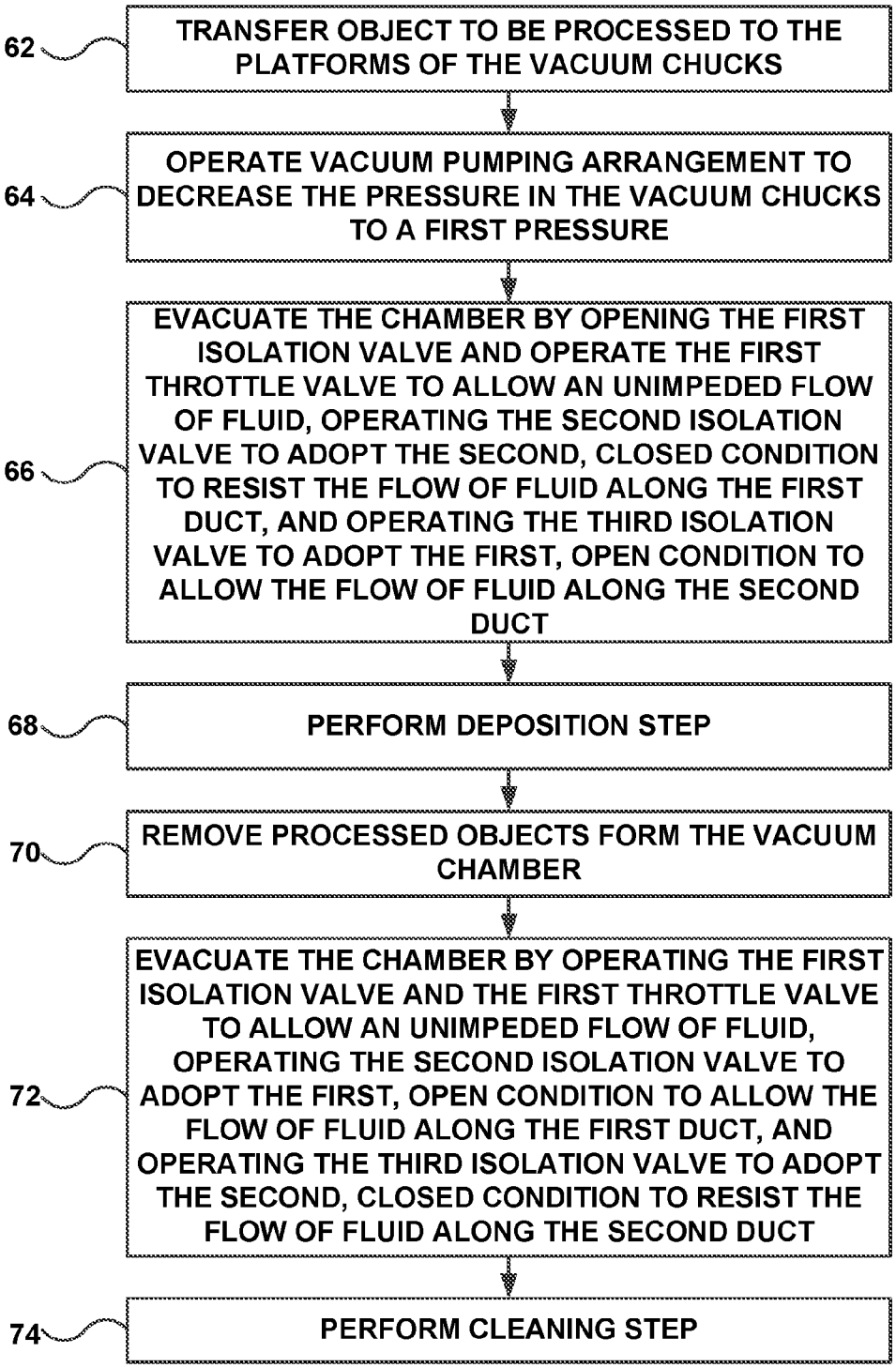
FIG. 3 is a flow diagram illustrating a method of evacuating a vacuum chamber with a vacuum pumping arrangement.

A method of evacuating the vacuum chamber 36 with the vacuum pumping arrangement 10 will now be described with reference to FIGS. 1-3. Processing in the chamber is performed in cycles. In the simplest method, objects, such as silicon wafers, to be processed are transferred to the platform(s) of the vacuum chucks possibly from a load lock chamber (62). The pumping arrangement is operated to decrease the pressure in the vacuum chucks 56 to a first pressure of around 1 to 20 mbar to maintain the objects in position during processing (64). The chamber is evacuated through chamber outlet 40 to a second pressure of around 800 mbar (66). The first pressure is at higher vacuum than the second pressure. As shown in FIG. 1, isolation valve 44 is opened and throttle valve 46 is operated to allow an unimpeded flow of fluid. The isolation valve 48 is operated to adopt the second condition for resisting the flow of fluid along duct 38 and isolation valve 50 is operated to adopt the first condition for allowing the flow of fluid along duct 42. A deposition step is performed at the relatively low vacuum of around 800 mbar (68). This processing step generates a relatively large amount of particles which is sufficient to cause damage to a known vacuum pumping arrangement. However, the evacuated gases are conveyed along the second duct to the second pump inlet 32 and even though the fluid is dusty it passes through only one pumping stage 22.

When the deposition step is completed, the processed objects are removed from the vacuum chamber (70). The vacuum chamber pressure is reduced by pumping fluid from chamber outlet 40 to the first pump inlet 28 through the booster pump 26 (72). As shown in FIG. 2, the isolation valve 44 and the throttle valve 46 are operated to allow the flow of fluid unimpeded. Valve 48 is placed in the second condition (i.e. opened) to allow the flow of fluid along the first duct 38. Valve 50 is placed in the first condition (i.e. closed) to resist the flow of fluid along the second duct 42. When the pressure in the vacuum chamber reaches around 1 to 20 mbar, a cleaning step is performed to clean the chamber (72). The cleaning step generates less dust compared to the deposition step and is not sufficient to cause significant damage to the vacuum pumping arrangement. Additionally, as a lower pressure is required for the cleaning step, the fluid is conveyed through the booster pump and through all of the stages of the backing pump.

When the cleaning step is complete, the throttle valve 46 throttles the flow of gas through the chamber outlet 40 thereby increasing the pressure from around 1 to 20 mbar to 800 mbar. Objects are then placed in the vacuum chamber and the processing cycle repeated.

The invention claimed is:

1. A method of evacuating a vacuum process chamber with a vacuum pumping arrangement, the method comprising:

conveying process fluid from the vacuum process chamber to a first pump inlet for pumping during a first processing step, wherein the first processing step is performed in the vacuum process chamber at a higher vacuum than a second processing step and generates a smaller amount of particles than the second processing step, and wherein the vacuum pumping arrangement comprises a pump outlet, a plurality of vacuum pumping stages, the first pump inlet through which process fluid from the vacuum process chamber can enter the vacuum pumping arrangement and pass through each of the plurality of vacuum pumping stages towards a pump outlet, and a second pump inlet through which process fluid can enter the vacuum pumping arrangement and pass through only one or more vacuum pumping stages of the plurality of vacuum pumping stages downstream of the most upstream vacuum pumping stage of the plurality of vacuum pumping stages; and conveying process fluid from the vacuum process chamber to the second pump inlet for pumping during the second processing step, wherein the second processing step is performed in the vacuum process chamber at a lower vacuum than the first processing step and generates a larger amount of particles than the first processing step.

2. The method of claim 1, wherein the vacuum pumping arrangement further comprises a fore-line assembly having a first duct for conveying process fluid from the vacuum process chamber to the first pump inlet, a second duct for conveying process fluid from the vacuum process chamber to the second pump inlet, and a valve arrangement, the method further comprising:

operating the valve arrangement to direct process fluid along the first duct during the second processing step and to direct process fluid along the second duct during the first processing step.

3. The method of claim 1 or 2, wherein process fluid entering the vacuum pumping arrangement through the second pump inlet passes through only the most downstream vacuum pumping stage of the plurality of vacuum pumping stages.

4. The method of claim 1, wherein the second processing step comprises a chemical vapor deposition step and the first processing step comprises a chamber cleaning or conditioning step.

5. The method of claim 2, wherein the fore-line assembly comprises a third duct for conveying fluid from a vacuum chuck of the vacuum process chamber, and wherein the third duct is open to the flow of fluid during at least the first processing step.

6. The method of claim 3, wherein the fore-line assembly comprises a third duct for conveying fluid from a vacuum chuck of the vacuum process chamber, and wherein the third duct is open to the flow of fluid during at least the first processing step.

7. The method of claim 2, wherein the second processing step comprises a chemical vapor deposition step and the first processing step comprises a chamber cleaning or conditioning step.

8. The method of claim 3, wherein the first processing step comprises a chemical vapor deposition step and the second processing step comprises a chamber cleaning or conditioning step.

9. The method of claim 4, wherein the first processing step comprises a sub-atmospheric chemical vapor deposition step.

* * * * *